US007477199B2

(12) United States Patent
Hotta et al.

(10) Patent No.: US 7,477,199 B2
(45) Date of Patent: Jan. 13, 2009

(54) ANTENNA DEVICE OPERABLE IN MULTIPLE FREQUENCY BANDS

(75) Inventors: Hiroyuki Hotta, Tokyo (JP); Satoshi Mizoguchi, Tokyo (JP); Koichi Sato, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 117 days.

(21) Appl. No.: 11/724,499

(22) Filed: Mar. 15, 2007

(65) Prior Publication Data

US 2008/0169981 A1 Jul. 17, 2008

(30) Foreign Application Priority Data

Jan. 16, 2007 (JP) ..... 2007-007104

(51) Int. Cl.
*H01Q 1/24* (2006.01)

(52) U.S. Cl. ..... 343/702; 343/700 MS

(58) Field of Classification Search ..... 343/700 MS, 343/702

See application file for complete search history.

(56) References Cited

U.S. PATENT DOCUMENTS 6,836,249 B2 * 12/2004 Kenoun et al. ..... 343/700 MS
6,861,986 B2 * 3/2005 Fang et al. ..... 343/700 MS
6,930,640 B2 * 8/2005 Chung et al. ..... 343/700 MS
7,136,022 B2 11/2006 Sato et al.
2005/0140554 A1 * 6/2005 Wang et al. ..... 343/702
2006/0145925 A1 * 7/2006 Mei ..... 343/700 MS
2007/0188388 A1 * 8/2007 Feng et al. ..... 343/700 MS

FOREIGN PATENT DOCUMENTS

JP 2006-157954 A 6/2006
JP 2006-196994 A 7/2006

* cited by examiner

*Primary Examiner*—Tan Ho
(74) *Attorney, Agent, or Firm*—Frishauf, Holtz, Goodman & Chick, P.C.

(57) ABSTRACT

There is provided an antenna device of a radio apparatus, including a fed partial element, a folded partial element and an open-ended partial element. The fed partial element is formed to be extended from a fed portion to a first branch portion where the folded partial element branches off. The folded partial element has a grounded end and has a forward path and a backward path short-circuited to each other. The folded partial element and a path on the fed partial element from the fed portion to the first branch portion have a summed length of about a half wavelength of a first frequency. The open-ended partial element branches off at a second branch portion. The open-ended partial element and a path on the fed partial element from the fed portion to the second branch portion have a summed length of about a one-fourth wavelength of a second frequency.

14 Claims, 13 Drawing Sheets

ANTENNA DEVICE OPERABLE IN MULTIPLE FREQUENCY BANDS

CROSS REFERENCE TO RELATED APPLICATIONS

This application is based upon and claims the benefit of priority from the prior Japanese Patent Application No. 2007-007104 filed on Jan. 16, 2007; the entire contents of which are incorporated herein by reference.

FIELD OF THE INVENTION

The present invention relates to an antenna device operable in multiple frequency bands, and in particular to one which may be built into a radio apparatus.

DESCRIPTION OF THE BACKGROUND

There is a trend that mobile phones or personal computers (PCs) with radio capability have multiple purposes and multiple functions. The above trend requires an antenna device which may be operable in multiple frequency bands or in a broad frequency range.

For the above requirement, e.g., the applicant applied for and obtained a patent on an invention of a built-in antenna of a radio apparatus which is operable in multiple frequency bands having impedance that may be smoothly matched, as disclosed in Japanese Patent Publication (Toroku), No. 3775795.

Another example of related art is a microstrip antenna disclosed in Japanese Patent Publication of Unexamined Applications (Kokai), No. 2006-157954, formed on a dielectric substrate and made operable in a broad frequency range.

The above built-in antenna of the "Toroku" reference includes a first antenna element being folded and a second antenna element being open-ended, both of which share a feeding point. The first antenna element and the second antenna element have a relatively lower resonant frequency and a relatively higher resonant frequency, respectively. The first antenna element has a forward path and a backward path short-circuited to each other at a shorting bridge which may be selectively located for impedance matching of the second antenna element.

As the resonant frequency of the second antenna element becomes higher, the shorting bridge has to be located closer to the feeding point for better impedance matching of the second antenna element. It may cause, however, the impedance to be highly inductive at the resonant frequency of the first antenna element.

As described above, there is a tendency that the impedance of each of the first antenna element and the second antenna element may not be separately adjusted if their resonant frequencies are spaced to some extent. As a separation of the resonant frequencies becomes greater, this tendency becomes clearer. Hence, it could be difficult to adapt the above built-in antenna for multiple functions of a radio apparatus supposing multiple frequencies which are spaced to some extent.

The above microstrip antenna of the "Kokai" reference includes a nearly T-shaped planar element and a linear element having a meander type portion, both being formed on a dielectric substrate and facing a ground pattern. It is mentioned in the "Kokai" reference that an electric performance of the microstrip antenna may be separately controlled in a 5 GHz band and in a 2.4 GHz band due to such an arrangement of the microstrip antenna.

The above microstrip antenna, using the dielectric substrate which is usually expensive, could hardly be applied to and built into mobile phones or PCs due to cost consideration. Apart from the cost, FIG. 4 of the above "Kokai" reference could suggest a built-in antenna formed by a flat element having a certain width, connected to a feeding point, and a branching (nearly T-shaped) linear element located at a side of the flat element opposite to the feeding point.

The above flat element having the certain width and connected to the feeding point, however, may have to be located closer to a ground circuit as the suggested antenna is built into an apparatus of a smaller size and a thinner shape. The suggested antenna may thus suffer from low impedance in such an arrangement.

A parasitic element could be added to the suggested antenna and inductively coupled to the feeding point for multiple resonances. It may be difficult, however, to locate the parasitic element close enough to the feeding point as both of them are separated by the flat element having the certain width.

SUMMARY OF THE INVENTION

To solve the technical problems described above, an advantage of the present invention is to provide an antenna device adapted for having multiple resonant frequencies, being built into an apparatus of a small size and a thin shape, and adjusting impedance separately at each resonant frequency in an improved manner.

To achieve the above advantage, one aspect of the present invention is to provide an antenna device of a radio apparatus usable at a first frequency and at a second frequency.

The antenna device has a fed partial element including a fed portion, a first branch portion and a second branch portion. The fed partial element is configured to be fed at the fed portion, and is formed in a manner to be extended from the fed portion to the first branch portion with a width.

The antenna device has a folded partial element branching off from the fed partial element at the first branch portion. The folded partial element includes a forward path from the first branch portion to a fold portion and a backward path from the fold portion to a grounded end.

The folded partial element and a path on the fed partial element from the fed portion to the first branch portion have a summed length of about a half wavelength of the first frequency. The grounded end is located no greater than a one-fifth wavelength of the first frequency apart from the fed portion. The forward path and the backward path are short-circuited at a bridge portion.

The antenna device has an open-ended partial element branching off from the fed partial element at the second branch portion. The open-ended partial element has an open end. The open-ended partial element and a path on the fed partial element from the fed portion to the second branch portion have a summed length of about a one-fourth wavelength of the second frequency.

DETAILED DESCRIPTION OF THE INVENTION

Figure 1:
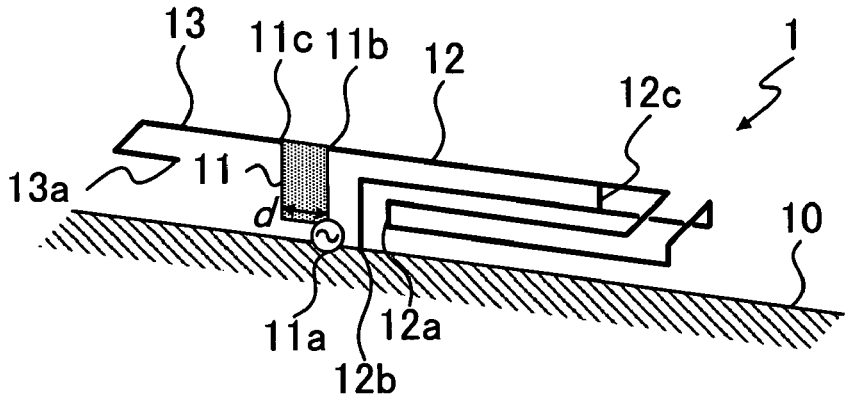
FIG. 1 shows a configuration and an external view of an antenna device of a first embodiment of the present invention.

A first embodiment of the present invention will be described with reference to FIGS. 1-19. FIG. 1 shows a configuration and an external view of an antenna device 1 of the first embodiment. The antenna device 1 is attached to an edge of a circuit board 10 which is built into a radio apparatus such as a mobile phone, a receiver or a personal computer (PC) having a radio capability. The antenna device 1 is connected to a radio circuit (not shown) provided on the circuit board 10.

The radio apparatus including the antenna device 1 may be used at a first frequency and a second frequency, at least. In FIG. 1, the circuit board 10 only shows a portion and around to which the antenna device 1 is attached.

The antenna device 1 has a fed partial element 11, a folded partial element 12 and an open-ended partial element 13. The fed partial element 11 has a fed portion 11*a*, a first branch portion 11*b* and a second branch portion 11*c*. The fed partial element 11 may be fed from the circuit board 10 at the fed portion 11*a*.

In FIG. 1, the fed portion 11*a* is shown without distinction from a feeding point provided on the circuit board 10. The fed partial element 11 is formed in a manner to be extended from the fed portion 11*a* to the first branch portion 11*b* with a width "d", as shown in FIG. 1.

The folded partial element 12 branches off from the fed partial element 11 at the first branch portion 11*b*. The folded partial element 12 is bent a few times and folded at a fold portion 12*a*. The folded partial element 12 ends at a grounded end 12*b* connected to a ground circuit provided on the circuit board 10.

The open-ended partial element 13 branches off from the fed partial element 11 at the second branch portion 11*c*. The open-ended partial element 13 is bent, e.g., twice as shown in FIG. 1. The open-ended partial element 13 ends at an open end 13*a*.

The folded partial element 12 includes a forward path from the first branch portion 11*b* to the fold portion 12*a*, and a backward path from the fold portion 12*a* to the grounded end 12*b*. The forward path and the backward path of the folded partial element 12 are short-circuited at a bridge portion 12*c* located between the first branch portion 11*b* (or the grounded end 12*b*) and the fold portion 12*a*.

Figure 2:
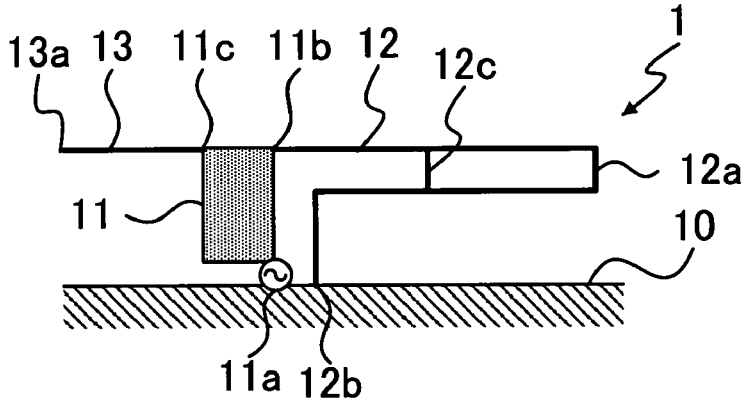
FIG. 2 shows a whole configuration and each section of the antenna device of the first embodiment in a simplified manner.

FIG. 2 shows a whole configuration and each section of the antenna device 1 in a simplified manner for convenience of explanation. There is a correspondence between each path of antenna currents formed in the antenna device 1 and each of resonant frequencies of the antenna device 1, which will be explained with reference to FIG. 3, FIG. 6 and so on.

Figure 3:
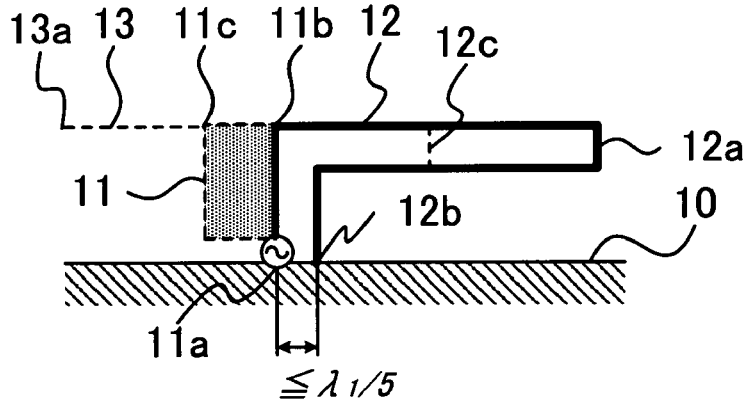
FIG. 3 shows and stresses a path on which an antenna current of a first resonant frequency of the first embodiment is distributed.

FIG. 3 shows and stresses a path on which an antenna current of the first frequency is distributed shown by a solid bold line in contrast with a rest shown by a dashed line. If the antenna device 1 is activated, the path of the antenna current is formed through the fed partial element 11 (from the fed portion 11*a* to the first branch portion 11*b*) and a whole of the folded partial element 12 (from the first branch portion 11*b*, via the fold portion 12*a*, to the grounded end 12*b*), as shown by the solid bold line in FIG. 3.

The fed partial element 11, or the folded partial element 12, may be sized so that a path length shown by the solid bold line in FIG. 3 is about a half wavelength of the first frequency. In addition, the grounded end 12*b* may be located close to the fed portion 11*a* to a certain extent. The path may thereby be configured as a kind of folded monopole antenna to be resonant at or around the first frequency.

Figure 4:
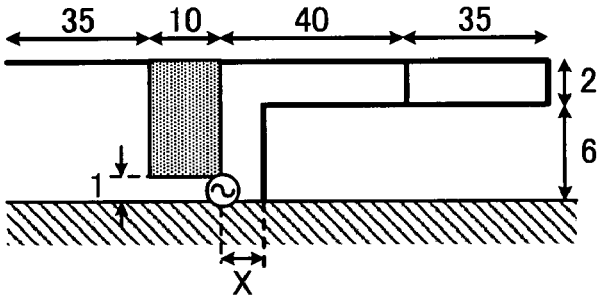
FIG. 4 shows a model used for estimating an effect of a separation between a fed portion and a grounded end of a first partial element of the antenna device of the first embodiment.

How close the grounded end 12*b* should be located to the fed portion 11*a* has been studied by a simulation, and will be described with reference to FIG. 4 and FIG. 5. FIG. 4 shows a model of the antenna device 1 used for the simulation by omitting a reference numeral but indicating a size (in millimeters) of each section of the antenna device 1 shown in FIG. 2.

As shown in FIG. 4, let a distance between the fed portion 11*a* and the grounded end 12*b* be a parameter X. What has been estimated for a few values of the parameter X is if the antenna device 1 is resonant or not in a frequency range including the first frequency (0.9±0.2 GHz for the model shown in FIG. 4). FIG. 5 shows a resonance characteristic of the model plotted on a graph formed by a horizontal frequency axis (in GHz) and a vertical axis representing a reactance component of impedance of the antenna device 1 viewed from the fed portion 11*a* (in ohms).

The simulation has been performed for the model shown in FIG. 4 while the parameter X is given one of following four values, which are 0.006λ (where λ is a wavelength of a frequency 0.9 GHz), 0.007λ, 0.13λ and 0.19λ.

Figure 5:
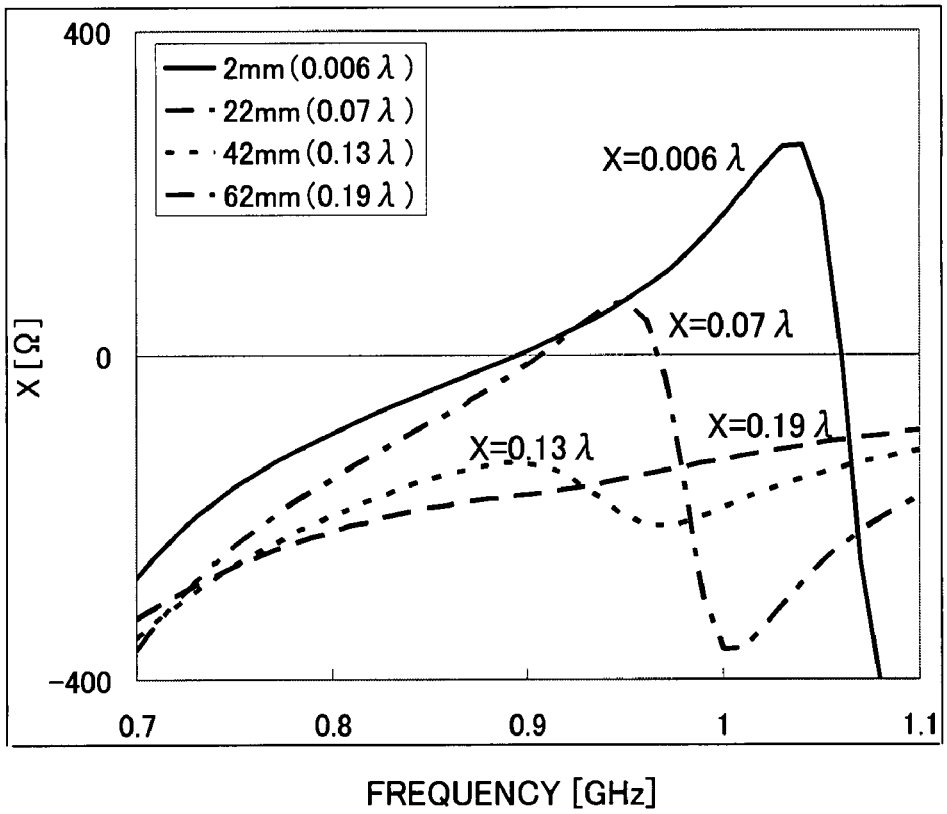
FIG. 5 shows a resonance characteristic of the model shown in FIG. 4.

In a frequency characteristic of a reactance component like FIG. 5, it may be determined that the antenna device is resonant at a frequency where the reactance component increases from negative to positive, or at least begins decreasing after increasing, as the frequency increases.

It is then determined that the antenna device 1 is resonant in the frequency range shown in FIG. 5 in the cases where $X \leqq 0.13\lambda$, and is not resonant in the case where $X=0.19\lambda$. In conclusion, the parameter X should be given a value no greater than about a one-fifth wavelength of the first frequency.

Figure 6:
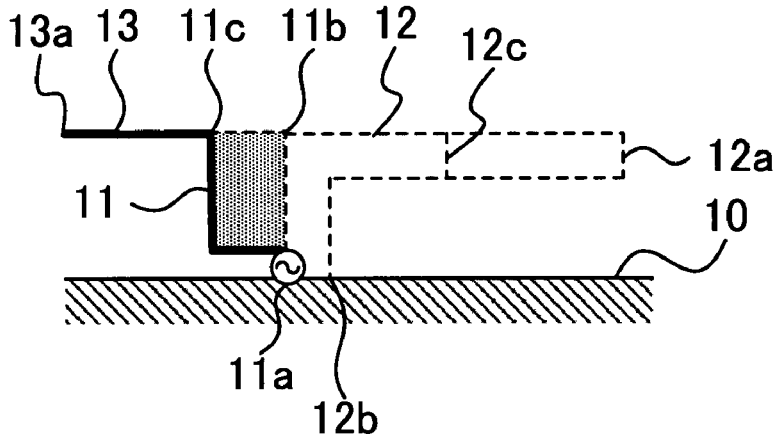
FIG. 6 shows and stresses a path on which an antenna current of a second resonant frequency of the first embodiment is distributed.

FIG. 6 shows and stresses a path on which an antenna current of the second frequency is distributed shown by a solid bold line in contrast with a rest shown by a dashed line. If the antenna device 1 is activated, the path of the antenna current is formed through the fed partial element 11 (from the fed portion 11*a*, not via the first branch portion 11*b*, to the second branch portion 11*c*) and a whole of the open-ended partial element 13 (from the second branch portion 11*c* to the open end 13*a*), as shown by the solid bold line in FIG. 6.

The fed partial element 11 or the open-ended partial element 13 may be sized so that a total length of the path shown by the solid bold line in FIG. 6 is about a one-fourth wavelength of the second frequency. The path may thereby be configured as a kind of open-ended monopole antenna to be resonant at or around the second frequency as shown in the previously mentioned "Toroku" reference.

In FIG. 6, there is a path going through the first branch portion 11*b* and the bridge portion 12*c* and then reaching the grounded end 12*b*, which may work as a kind of stub for the above open-ended monopole antenna. Hence, impedance of the above open-ended monopole antenna viewed from the fed portion 11*a* may be adjusted depending on selection of a location of the bridge portion 12*c*.

It may be assumed that the bridge portion 12*c* is located by default so that a path length from the fed portion 11*a* to the grounded end 12*b*, via the first branch portion 11*b* and the bridge portion 12*c*, is a half wavelength of the second frequency. The bridge portion 12*c* may be selectively located around the default location so that the impedance of the above open-ended monopole antenna viewed from the fed portion 11*a* may be suitably adjusted.

Apart from the present invention, assume a usual antenna configuration in which the fed partial element 11 does not have the width "d" shown in FIG. 1. If the first frequency and the second frequency are spaced to some extent, the impedance viewed from the fed portion 11*a* at the first frequency becomes more inductive as the bridge portion 12*c* is located closer to the fed portion 11*a*, or to the grounded end 12*b*. At the first frequency, radiation efficiency of the antenna device 1 thereby decreases. Hence, it is difficult in the usual antenna configuration to adjust the impedance separately at each of the first frequency and the second frequency, which are spaced to some extent.

As to the antenna device 1 of the present invention, as the fed partial element 11 has the width "d", the impedance viewed from the fed portion 11*a* is given capacitive property at the first frequency. The capacitive property may have an effect to cancel inductive property which is given if the bridge portion 12*c* is located close to the fed portion 11*a* or to the grounded end 12*b*. Hence, it is not difficult to adjust the impedance separately at each of the first frequency and the second frequency, which are spaced to some extent.

Figure 7:
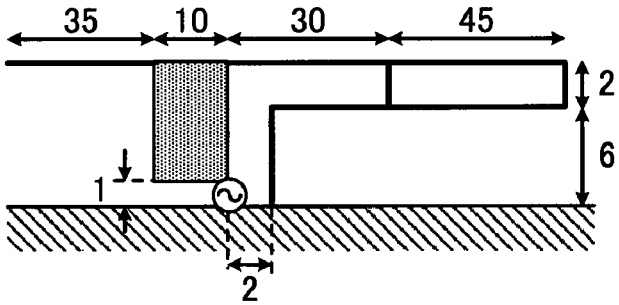
FIG. 7 shows a model used for estimating cancellation of inductive property of impedance of the antenna device of the first embodiment.
Figure 8:
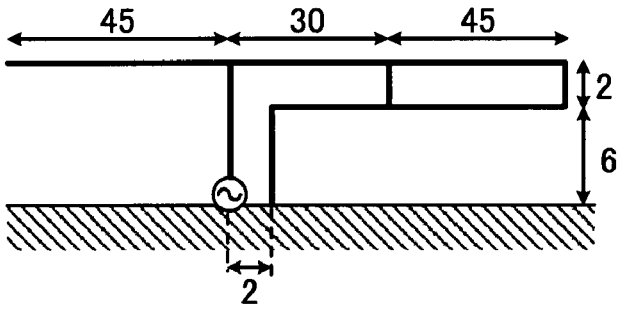
FIG. 8 shows a model of a usual antenna configuration showing inductive property of impedance.

This aspect of the antenna device 1 has been studied by a simulation, and will be described with reference to FIGS. 7-9. FIG. 7 shows a model of the antenna device 1 used for the simulation by omitting a reference numeral but indicating a size (in millimeters) of each of the sections of the antenna device 1 shown in FIG. 2. FIG. 8 shows a model of the usual antenna configuration in which the fed partial element 11 does not have the width "d" shown in FIG. 1, for comparison, indicating a size (in millimeters) of each section of the usual antenna configuration.

The impedance viewed from the fed portion 11*a* has been estimated by the simulation using the model shown in FIG. 7 and the model shown in FIG. 8 in a frequency range including the first frequency (0.7-1.0 GHz for the model shown in FIG. 7 or FIG. 8). FIG. 9 is a Smith chart that represents the estimated impedance characteristic. In FIG. 9, usual scales of a Smith chart are omitted for simplicity.

Figure 9:
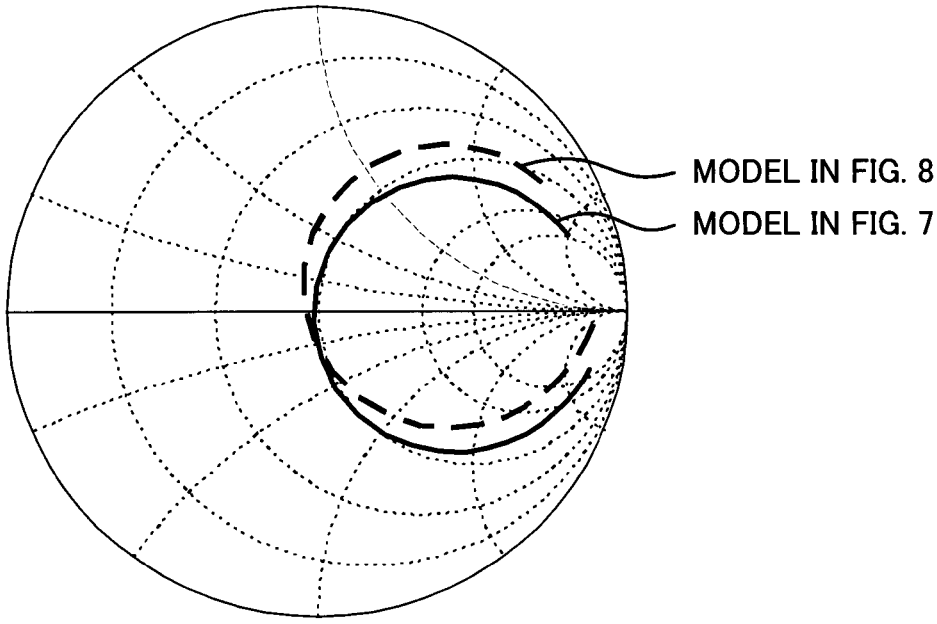
FIG. 9 is a Smith chart showing impedance characteristic of the models shown in FIG. 7 and in FIG. 8.

In FIG. 9, the impedance characteristic of the model shown in FIG. 7 and that of the model shown in FIG. 8 are shown by a solid line and by a dashed line, respectively. The impedance characteristic of the model shown in FIG. 8, where the fed partial element 11 has no width "d", shows inductive property and is biased upwards on the Smith chart. The impedance characteristic of the model shown in FIG. 7, on the other hand, is shown nearly in the middle of the Smith chart as the inductive property is canceled by an effect of the fed partial element 11 having a ten-millimeter width as shown in FIG. 7.

Figure 10:
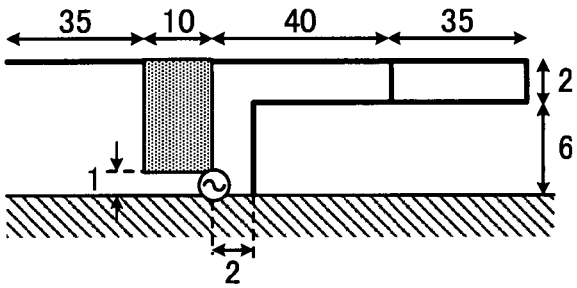
FIG. 10 shows a model used for estimating a broader frequency characteristic of the antenna device of the first embodiment.
Figure 11:
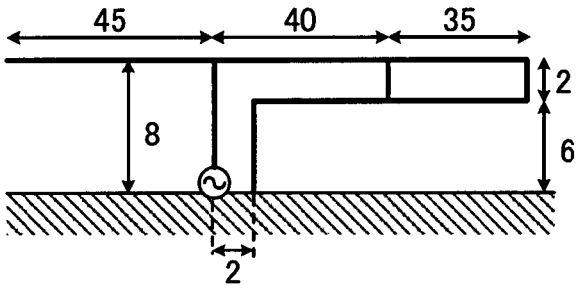
FIG. 11 shows a model of the usual antenna configuration for comparison with FIG. 10.

The fed partial element 11 of the antenna device 1 having the width "d", as shown in FIG. 1, may have an effect to make the frequency characteristic around the second frequency broader than that of the usual antenna configuration having no width "d". This aspect of the antenna device 1 has been studied by a simulation, and will be described with reference to FIGS. 10-12. FIG. 10 shows a model of the antenna device 1 used for the simulation, similarly to FIG. 7. FIG. 11 shows a model of the usual antenna configuration for comparison, similarly to FIG. 8.

Figure 12:
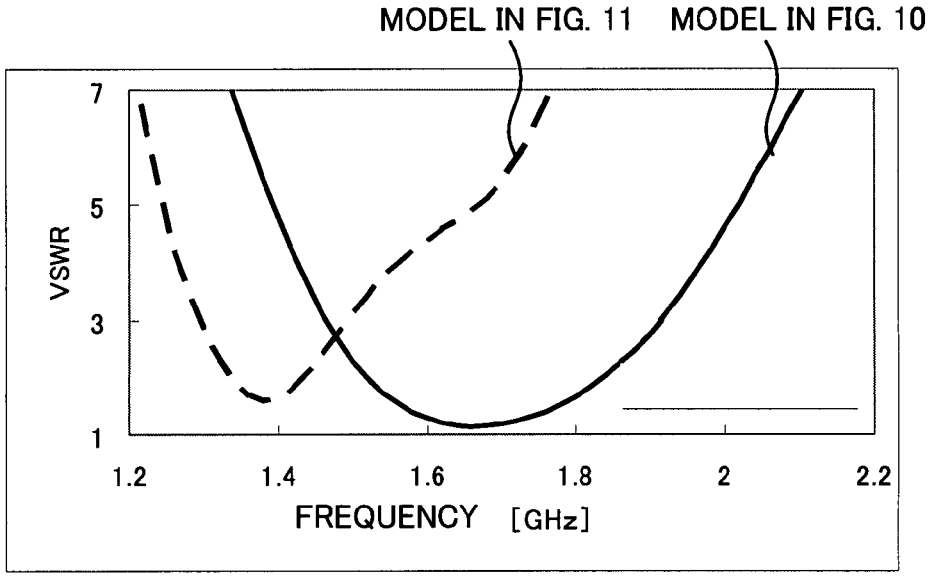
FIG. 12 shows a VSWR-frequency characteristic of the models shown in FIG. 10 and in FIG. 11.

By the simulation using the model shown in FIG. 10 and the model shown in FIG. 11, a voltage standing wave ratio (VSWR) at the fed portion 11*a* has been estimated in a frequency range including the second frequency (1.2-2.2 GHz for the model shown in FIG. 10 or FIG. 11). FIG. 12 shows a VSWR-frequency characteristic of each of the models. In FIG. 12, the VSWR characteristic of the model shown in FIG. 10 and that of the model shown in FIG. 11 are shown by a solid line and by a dashed line, respectively.

FIG. 12 shows that the fed partial element 11 of the model shown in FIG. 10, having a ten-millimeter width, has an effect to make the frequency characteristic around the second frequency broader than that of the model shown in FIG. 11.

Figure 13:
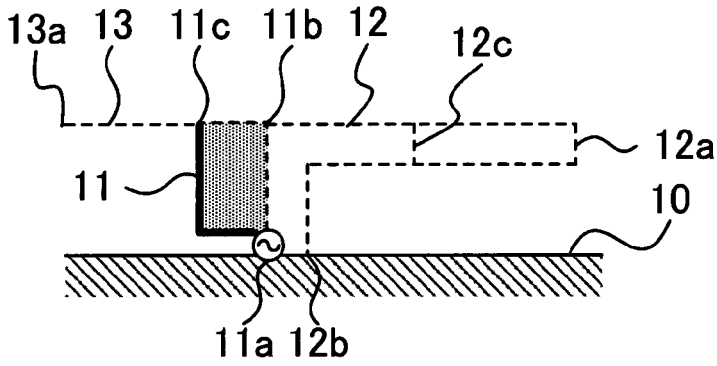
FIG. 13 shows and stresses a path on which an antenna current of a third resonant frequency of the first embodiment is distributed.

The antenna device 1 has resonant frequencies other than the first frequency and the second frequency, which are a third frequency and a fourth frequency and will be described with reference to FIG. 13 and FIG. 14. FIG. 13 shows and stresses a path on which an antenna current of the third frequency is distributed shown by a solid bold line in contrast with a rest shown by a dashed line.

If the antenna device 1 is activated, the path of the antenna current is formed through the fed partial element 11 (from the fed portion 11*a*, not via the first branch portion 11*b*, to the second branch portion 11*c*) as shown by the solid bold line in FIG. 13. The path goes along a fringe portion of the fed partial element 11 as shown in FIG. 13, as the antenna current tends to be distributed mainly along the fringe portion.

The antenna device 1 is resonant at a frequency where a one-fourth wavelength is a length of the path shown by the solid bold line in FIG. 13. The fed partial element 11 may be sized so that the length of the path shown by the solid bold line in FIG. 13 is about a one-fourth wavelength of the third frequency. The radio apparatus including the antenna device 1 may thereby be used at the third frequency.

Figure 14:
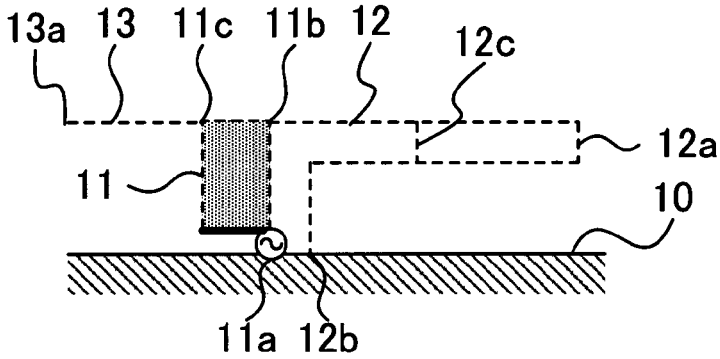
FIG. 14 shows and stresses a path on which an antenna current of a fourth resonant frequency of the first embodiment is distributed.

FIG. 14 shows and stresses a path on which an antenna current of the fourth frequency is distributed shown by a solid bold line in contrast with a rest shown by a dashed line. If the antenna device 1 is activated, the path of the antenna current is formed from the fed portion 11*a* in direction of the width of the fed partial element 11, as shown in FIG. 14.

The antenna device 1 is resonant at a frequency where a one-fourth wavelength is a length of the path shown by the solid bold line in FIG. 14. The fed partial element 11 may be sized so that the length of the path shown by the solid bold line in FIG. 14 is about a one-fourth wavelength of the fourth frequency. The radio apparatus including the antenna device 1 may thereby be used at the fourth frequency.

Figure 15:
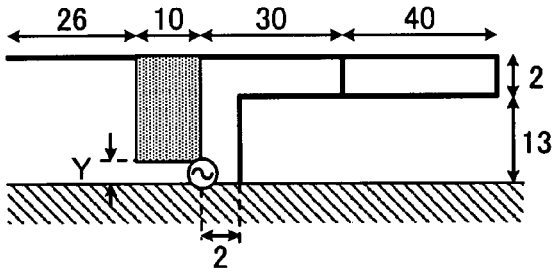
FIG. 15 shows a model used for estimating an effect of a distance between the fed partial element and a ground circuit of the antenna device of the first embodiment.

The antenna device 1 shows a characteristic affected by a distance between the fed partial element 11 and the ground circuit of the circuit board 10 in and around a frequency range between the third frequency and the fourth frequency. This aspect of the antenna device 1 has been studied by a simulation, and will be described with reference to FIG. 15 and FIG. 16. FIG. 15 shows a model of the antenna device 1 used for the simulation by omitting a reference numeral but indicating a size (in millimeters) of each of the sections of the antenna device 1 shown in FIG. 2.

Figure 16:
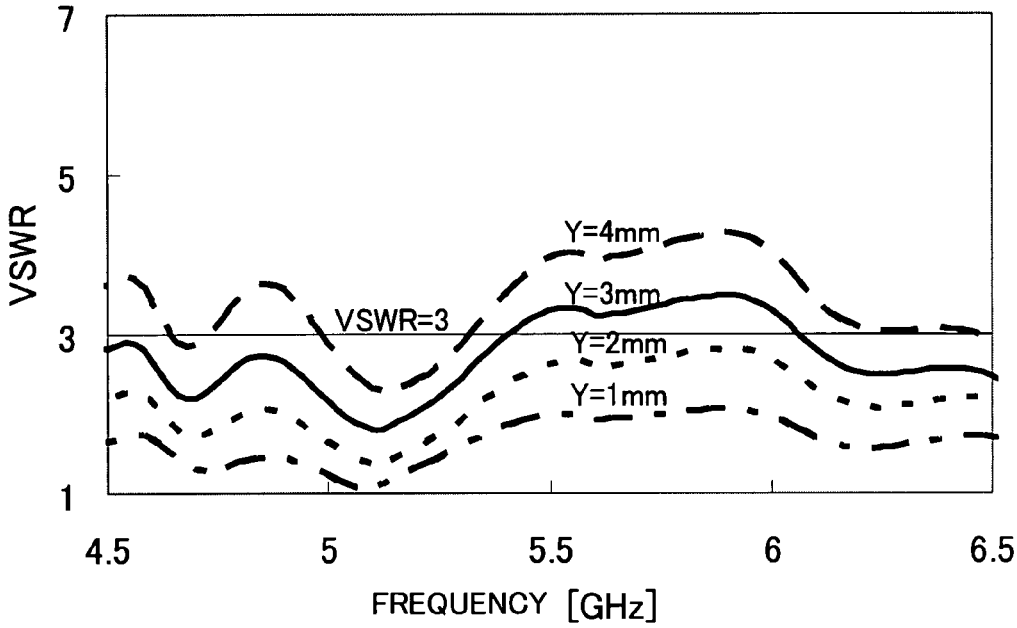
FIG. 16 shows a VSWR-frequency characteristic of the model, shown in FIG. 15, of the antenna device of the first embodiment.

As shown in FIG. 15, let a distance between the fed partial element 11 and the ground circuit of the circuit board 10 be a parameter Y. A VSWR at the fed portion 11*a* has been estimated for a few values of the parameter Y in a frequency range including the third frequency (4.5-6.5 GHz for the model shown in FIG. 15). FIG. 16 shows a frequency characteristic of the VSWR represented by four curves each of which corresponds to Y=4 mm, Y=3 mm, Y=2 mm, and Y=1 mm in descending order.

So as to let the VSWR≦3, e.g., in FIG. 16, it is necessary to let Y≦3 mm at a lower end 4.5 GHz, to let almost Y≦2.5 mm at a mid frequency 5.5 GHz, and to let Y≦4 mm at an upper end 6.5 GHz. A value of a right hand side of each of above inequalities is no greater than a one-twentieth wavelength of the corresponding frequency. Hence, it is suitable to let the parameter Y be no greater than a one-twentieth wavelength of the third frequency by default.

Figure 17:
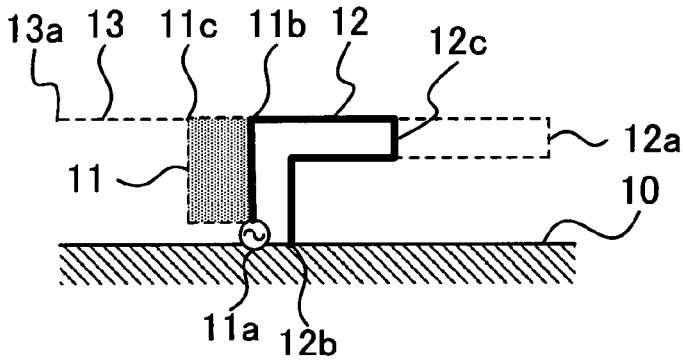
FIG. 17 shows and stresses a path on which an antenna current of a fifth resonant frequency of the first embodiment is distributed.

The antenna device 1 has a resonant frequency other than the first to fourth frequencies, which is a fifth frequency and will be described with reference to FIG. 17. FIG. 17 shows and stresses a path on which an antenna current of the fifth frequency is distributed shown by a solid bold line in contrast with a rest shown by a dashed line.

If the antenna device 1 is activated, the path of the antenna current is formed from the fed portion 11*a*, via the first branch portion 11*b* and the fold portion 12*c*, to the grounded end 12*b* as shown by the solid bold line in FIG. 17.

The antenna device 1 is resonant at a frequency where a half wavelength, or an integer times of the half wavelength, is a length of the path shown by the solid bold line in FIG. 17. If the bridge portion 12*c* is located so that the above path length is a half wavelength of the second frequency, as described earlier, the fifth frequency is determined together. On the other hand, the bridge portion 12*c* may be located so as to determine the fifth frequency apart from adjustment of the impedance at the second frequency. The second frequency does not change its value much depending on the location of the bridge portion 12*c*, i.e., being robust to a change of that location.

Figure 18:
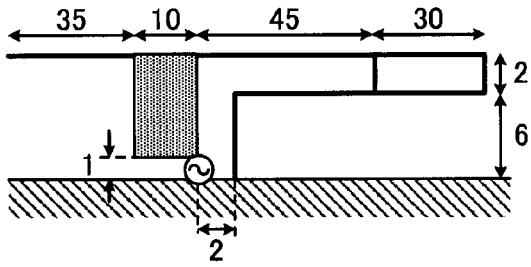
FIG. 18 shows a model used for estimating an example of the resonance characteristic of the antenna device of the first embodiment.
Figure 19:
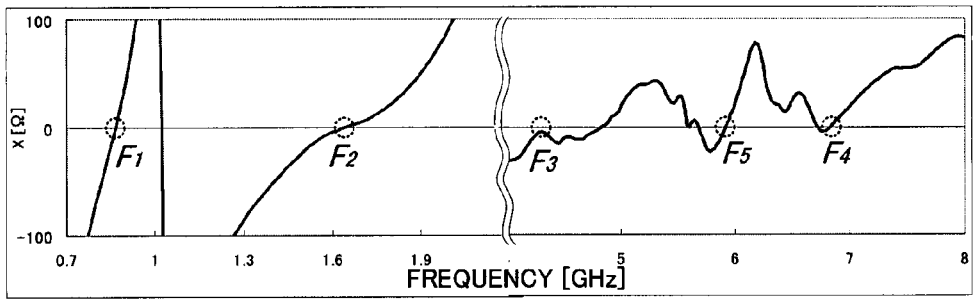
FIG. 19 shows a resonance characteristic of the model, shown in FIG. 18, of the antenna device of the first embodiment.

An example of the resonance characteristic of the antenna device 1 from the first to fifth frequencies will be described with reference to FIG. 18 and FIG. 19. FIG. 18 shows a model of the antenna device 1 used for estimating the resonance characteristic by omitting a reference numeral but indicating a size (in millimeters) of each of the sections of the antenna device 1 shown in FIG. 2. FIG. 19 shows a resonance characteristic of the model plotted on a graph formed by a horizontal frequency axis (in GHz) and a vertical axis representing a reactance component of impedance of the antenna device 1 viewed from the fed portion 11*a* (in ohms).

It may be determined that the antenna device is resonant at a frequency where the reactance component increases from negative to positive, or at least begins decreasing after increasing, as the frequency increases. Those frequencies are indicated in FIG. 19 by reference numerals "F1" to "F5" corresponding to the first to fifth frequencies, respectively.

In FIG. 19, another resonance is observed at a frequency slightly less than 5 GHz, but is not counted in as that frequency is a third harmonic of the second frequency which may not be independently selected. The fifth frequency "F5" may change its value and may be located higher or lower than each of the other resonant frequencies depending on the location of the bridge portion 12*c*.

According to the first embodiment of the present invention described above, an antenna device capable of being built into a radio apparatus of a small size and a thin shape may be configured to have multiple resonant frequencies in a broad frequency range, e.g., as shown in FIG. 19. In addition, impedance of the antenna device may be adjusted separately at each of the resonant frequencies in an improved manner.

Figure 20:
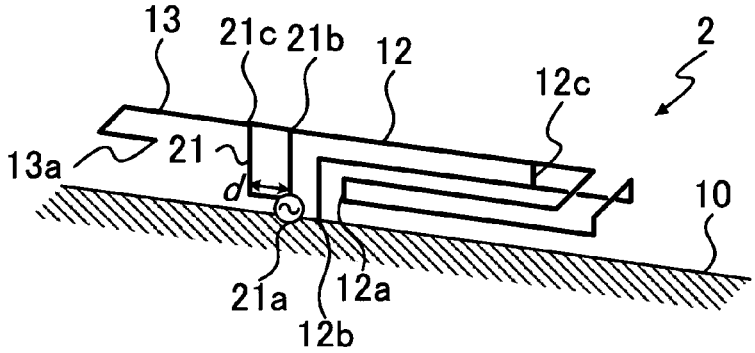
FIG. 20 shows a configuration and an external view of an antenna device of a second embodiment of the present invention.

A second embodiment of the present invention will be described with reference to FIGS. 20-22. FIG. 20 shows a configuration and an external view of an antenna device 2 of the second embodiment. The antenna device 2 is attached to an edge of a circuit board 10 which is included in a radio apparatus and is connected to a radio circuit (not shown) provided on the circuit board 10, similarly to the antenna device 1 of the first embodiment. The radio apparatus including the antenna device 2 may be used at the first frequency and the second frequency, at least, similarly to the antenna device 1 of the first embodiment.

The antenna device 2 has a fed partial element 21. The antenna device 2 has a folded partial element and an open-ended partial element, being a same as the folded partial element 12 and the open-ended partial element 13 of the first embodiment, respectively. The fed partial element 21 is fed from the circuit board 10 at a fed portion 21*a*. In FIG. 20, the fed portion 21*a* is shown without distinction from a feeding point provided on the circuit board 10.

The fed partial element 21 is formed as only a fringe portion of a piece going from the fed portion 11*a* to the first branch portion 21*b* with a width "d", which corresponds to the fed partial element 11 of the first embodiment. In FIG. 20, e.g., the fed partial element 21 is formed like a rectangular loop. The fed partial element 21 formed as described above needs less material and weighs less than the fed partial element 11 of the first embodiment.

The folded partial element 12, the same as that of the first embodiment, branches off from the fed partial element 21 at the first branch portion 21*b*. The open-ended partial element 13, the same as that of the first embodiment, branches off from the fed partial element 21 at the second branch portion 21*c*.

The antenna device 2 shows a resonance characteristic which will be described with reference to FIG. 21 and FIG. 22, in comparison with the resonance characteristic of the antenna device 1 of the first embodiment. FIG. 21 shows a model of the antenna device 2 to be compared with the model of the antenna device 1 shown in FIG. 10. FIG. 21 shows the model of the antenna device 2 by omitting a reference numeral but indicating a size (in millimeters) of each of the sections of the antenna device 2, similarly to FIG. 10.

Figure 21:
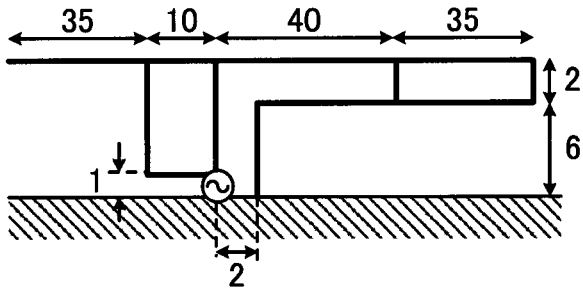
FIG. 21 shows a model used for estimating a VSWR-frequency characteristic of the antenna device of the second embodiment.

By a simulation using the model shown in FIG. 10 and the model shown in FIG. 21, a VSWR at the fed portion 11*a* or 21*a* has been estimated in a frequency range 1-9 GHz. FIG. 22 shows on an upper half thereof a VSWR-frequency characteristic in a lower portion of the frequency range. FIG. 22 shows on a lower half thereof the VSWR-frequency characteristic in an upper portion of the frequency range.

Figure 22:
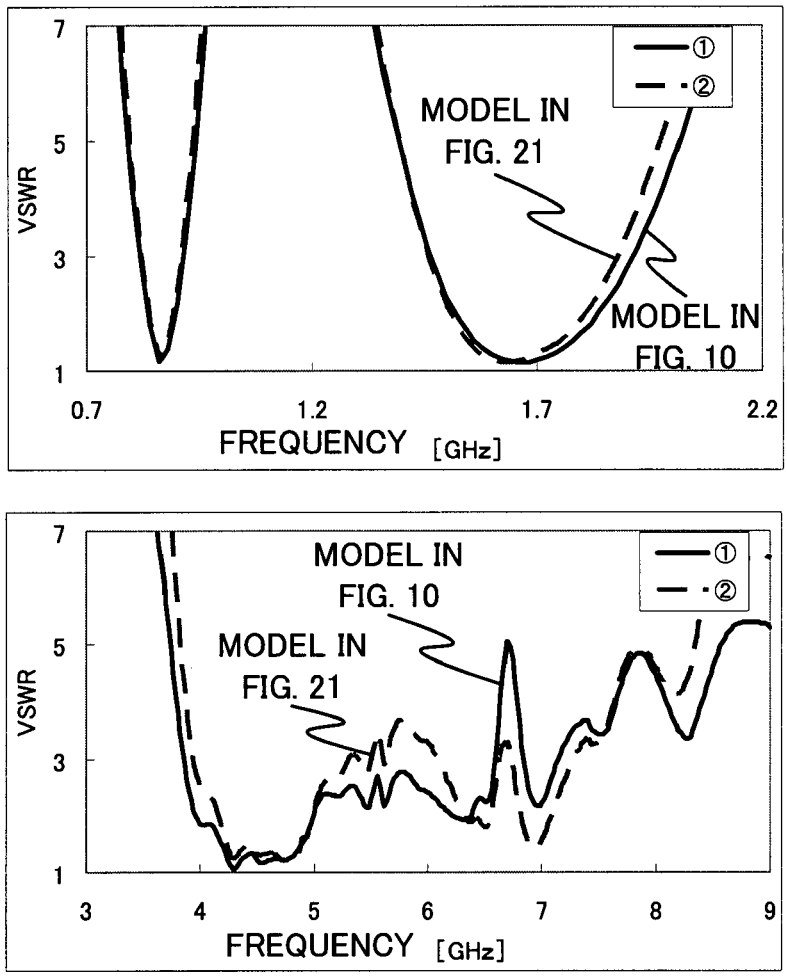
FIG. 22 shows a VSWR-frequency characteristic of the model shown in FIG. 21 of the second embodiment in comparison with that of the model shown in FIG. 10 of the first embodiment.

As shown in FIG. 22, the characteristic of the model shown in FIG. 21 of the second embodiment is not much different from the characteristic of the model shown in FIG. 10 of the first embodiment. That is, the antenna device 2 has an effect almost a same as the effect of the antenna device 1 of the first embodiment, by using the fed partial element 21 which needs less material.

According to the second embodiment of the present invention described above, the antenna device may weigh less by using less material, while maintaining performance not much different than the performance of the first embodiment.

Figure 23:
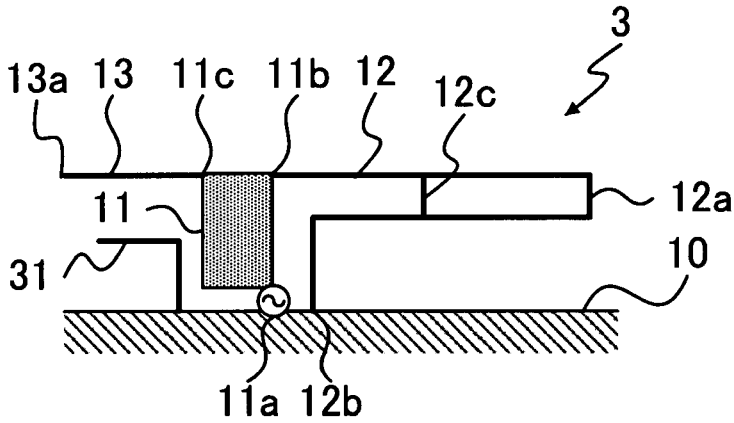
FIG. 23 shows a whole configuration and each section of an antenna device of a third embodiment of the present invention in a simplified manner.

A third embodiment of the present invention will be described with reference to FIGS. 23-27. The antenna device 1 of the first embodiment may be modified to be an antenna device 3 of the third embodiment by including a parasitic element. FIG. 23 shows a whole configuration and each section of the antenna device 3 in a simplified manner, similarly to FIG. 2 of the first embodiment. The antenna device 3 has a same configuration as that of the antenna device 1 shown in FIG. 2, and further includes a parasitic element 31.

The parasitic element 31 has an end connected to the ground circuit of the circuit board 10. The parasitic element 31 should usually be located around and inductively coupled to the fed portion 11*a* for practical use. It may be difficult, however, to let the parasitic element 31 be inductively coupled to the fed portion 11*a* for a reason of implementation, particularly in a case where the antenna device 3 is built into a radio apparatus of a small size and a thin shape.

As described earlier in the "background" section, the "Kokai" reference has suggested the antenna formed by an element having a certain width and connected to a feeding point in combination with a branching linear element. For that suggested antenna, it may be difficult to locate the parasitic element close enough to the feeding point as both of them are separated by the element having the certain width. As to the antenna device 3, on the other hand, the parasitic element 31 may be located close to the fed partial element 11, as shown in FIG. 23, even though it may hardly be located close to the fed portion 11*a*.

On the fed partial element 11, an antenna current is mainly distributed along the fringe portion as shown in FIG. 6. The parasitic element 31 may thereby be inductively coupled to the fed partial element 11.

Figure 24:
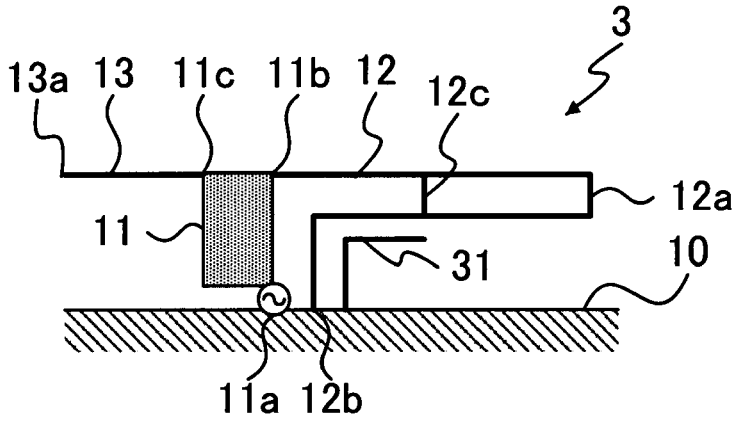
FIG. 24 shows another configuration of the antenna device of the third embodiment by changing a location of a parasitic element.

FIG. 24 shows a whole configuration and each section of the antenna device 3 in a case where the parasitic element 31 may be located close to the fed portion 11*a*. FIG. 24 is a same as FIG. 23 except the location of the parasitic element 31. If such an arrangement is available, the parasitic element 31 may be located close to the fed portion 11*a* as usual. That is, the antenna device 3 of the third embodiment may select a location of the parasitic element 31 more flexibly than an antenna of another configuration.

Figure 25:
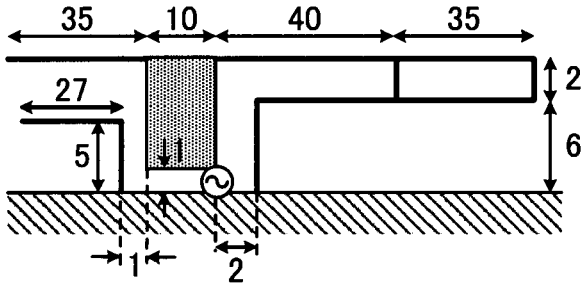
FIG. 25 shows a model used for estimating a VSWR-frequency characteristic of the antenna device of third embodiment shown in FIG. 23.
Figure 26:
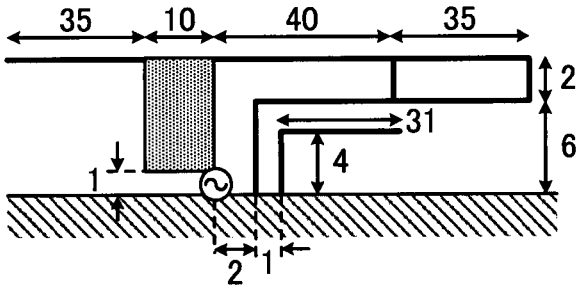
FIG. 26 shows a model used for estimating a VSWR-frequency characteristic of the antenna device of third embodiment shown in FIG. 24.

The antenna device 3 shows a resonance characteristic which will be described with reference to FIGS. 25-27, in comparison with the resonance characteristic of the antenna device 1 of the first embodiment. FIG. 25 and FIG. 26 show models of the antenna device 3 shown in FIG. 23 and FIG. 24, respectively. FIG. 25 and FIG. 26 show the models, similarly to FIG. 10, by omitting a reference numeral but indicating a size (in millimeters) of each of the sections of the antenna device 3.

By a simulation using the models shown in FIG. 10, FIG. 25 and FIG. 26, a VSWR at the fed portion 11*a* has been estimated in a frequency range 1.4-2.4 GHz. FIG. 27 show a solid curve, a dashed curve and a dotted curve representing VSWR-frequency characteristics of the models shown in FIG. 10, FIG. 25 and FIG. 26, respectively.

Figure 27:
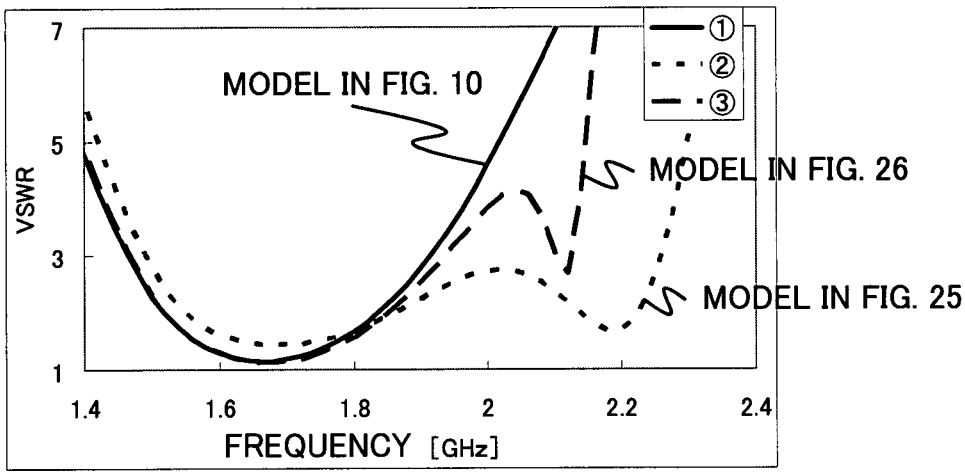
FIG. 27 shows a VSWR-frequency characteristic of the models shown in FIG. 25 and in FIG. 26 of the third embodiment in comparison with that of the model shown in FIG. 10 of the first embodiment.

FIG. 27 shows that each of the models shown in FIG. 25 and FIG. 26 has an additional resonant frequency (about 2.2 GHz and about 2.1 GHz for the models shown in FIG. 25 and FIG. 26, respectively) while maintaining the resonance characteristic at the second frequency.

According to the third embodiment of the present invention described above, the antenna device may have an additional resonant frequency, and may select a location of the parasitic element more flexibly than an antenna of another configuration.

A fourth embodiment of the present invention will be described with reference to FIGS. 28-37. The fourth embodiment is a collection of modified examples of the antenna device 1 of the first embodiment. Similar modifications of the antenna device 2 of the second embodiment or of the antenna device 3 of the third embodiment are omitted to be shown, as they basically make no difference. Each of following drawings gives a reference numeral to a section which is a same as that of the antenna device 1 only when necessary so as to avoid intricacy.

Figure 28:
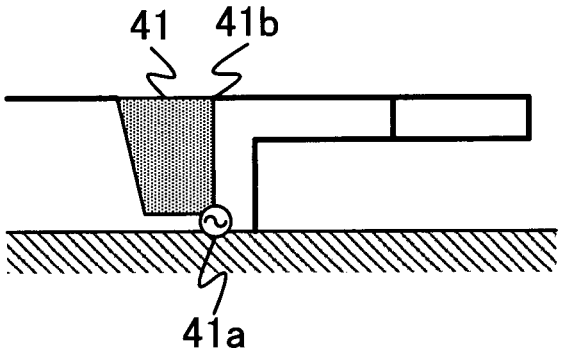
FIG. 28 shows a first modification of the antenna device of the first embodiment included in a collection which is a fourth embodiment of the present invention.

FIG. 28 shows a first modification of which a fed partial element 41 is formed in a manner to be extended from a fed portion 41*a* to a first branch portion 41*b* while gradually broadening a width thereof. The first modification has a same effect as that of the antenna device 1 regardless of the above modified form of the fed partial element 41.

Figure 29:
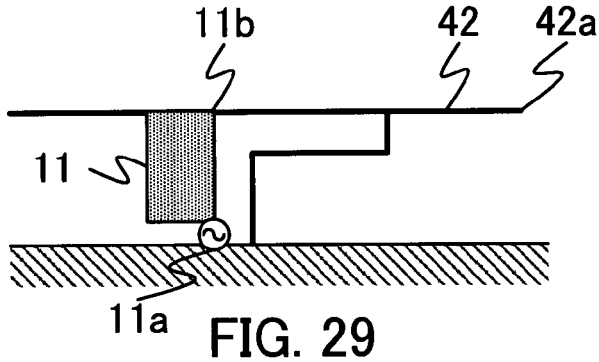
FIG. 29 shows a second modification included in the fourth embodiment.

FIG. 29 shows a second modification in which the folded partial element 12 of the antenna device 1 has been replaced by an open-ended partial element 42. The second modification has a same effect as that of the antenna device 1 by sizing partial elements thereof so that a sum of a path length from the fed portion 11*a* to the first branch portion 11*b* (within the fed partial element 11) and a path length from the first branch portion 11*b* to an open end 42*a* (a whole length of the open-ended partial element 42) is a one-fourth wavelength of the first frequency.

Figure 30:
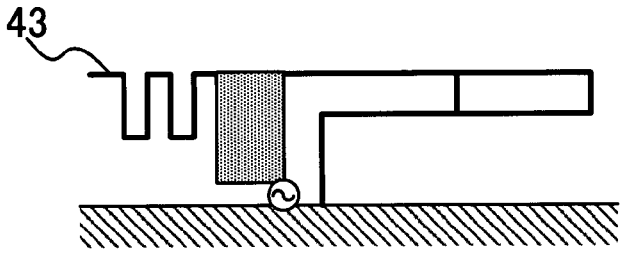
FIG. 30 shows a third modification included in the fourth embodiment.

FIG. 30 shows a third modification in which the open-ended partial element 13 of the antenna device 1 has been replaced by a meander partial element 43. The third modification may be sized smaller while maintaining a same effect as that of the antenna device 1 by selecting a shape of the meander partial element 43.

Figure 31:
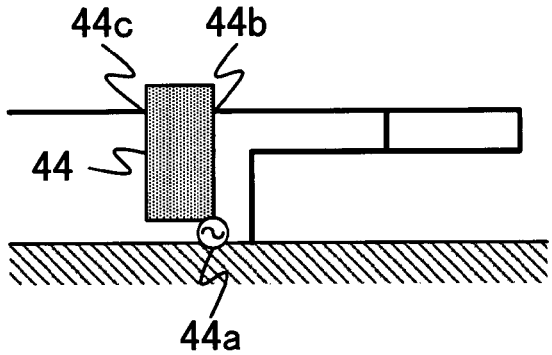
FIG. 31 shows a fourth modification included in the fourth embodiment.

FIG. 31 shows a fourth modification including a fed partial element 44 which is extended beyond a first branch portion 44*b* or a second branch portion 44*c*, or both of them. The fourth modification has a same effect as that of the antenna device 1 regardless of the above modified form of the fed partial element 44.

Figure 32:
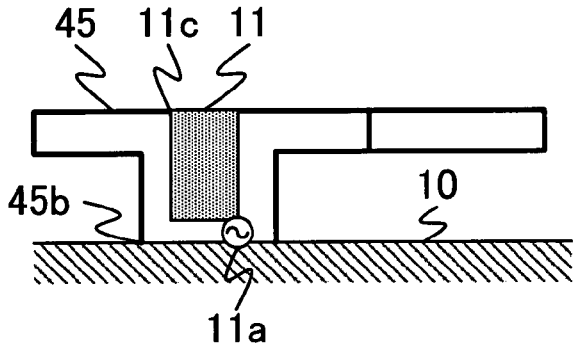
FIG. 32 shows a fifth modification included in the fourth embodiment.

FIG. 32 shows a fifth modification in which the open-ended partial element 13 of the antenna device 1 has been replaced by a folded partial element 45. The folded partial element 45 ends at a grounded end 45*b* which is connected to the ground circuit of the circuit board 10.

The fifth modification has a same effect as that of the antenna device 1 by sizing the partial elements thereof so that a sum of a path length from the fed portion 11*a* to the first branch portion 11*b* (within the fed partial element 11) and a path length from the first branch portion 11*b* to an open end 42*a* (a whole length of the folded partial element 45) is a half wavelength of the second frequency, and by locating the grounded end 45*b* close to the fed portion 11*a* to some extent. The fifth modification has an additional effect of higher impedance at the second frequency.

Figure 33:
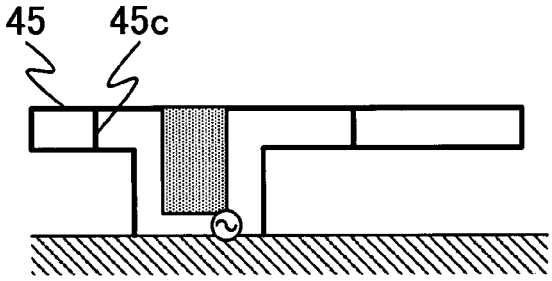
FIG. 33 shows a sixth modification included in the fourth embodiment.
Figure 34:
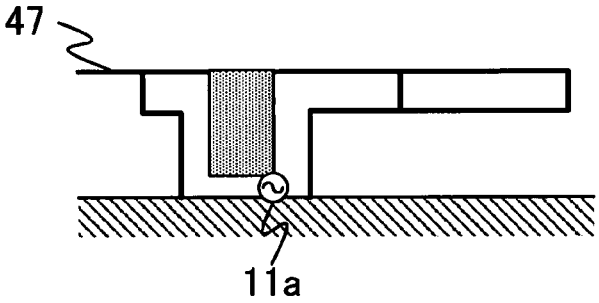
FIG. 34 shows a seventh modification included in the fourth embodiment.

FIG. 33 shows a sixth modification in which a forward path and a backward path of the folded partial element 45 of the fifth modification are short-circuited at a bridge portion 45*c*. FIG. 34 shows a seventh modification in which the folded partial element 45 of the sixth modification is replaced by an open-ended partial element 47. The sixth and seventh modifications both have a same effect as that of the antenna device 1 and an additional effect that impedance may be adjusted more elaborately.

Figure 35:
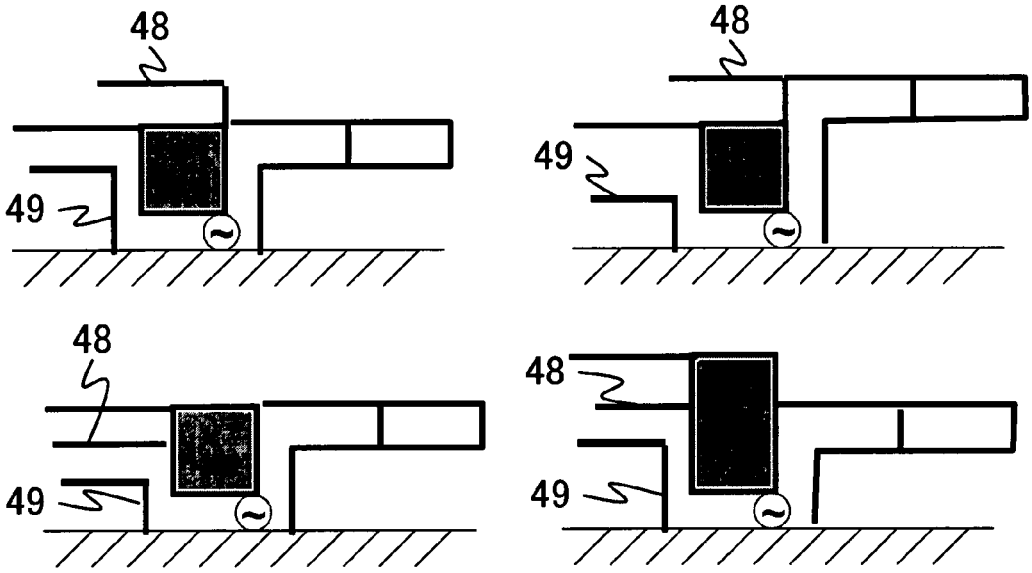
FIG. 35 shows four examples of the fourth embodiment further including an additional partial element and an additional parasitic element.

FIG. 35 shows four examples in each of which the antenna device 1 or its modification may have additional resonant frequencies by further including an open-ended partial element 48 and a parasitic element 49.

Figure 36:
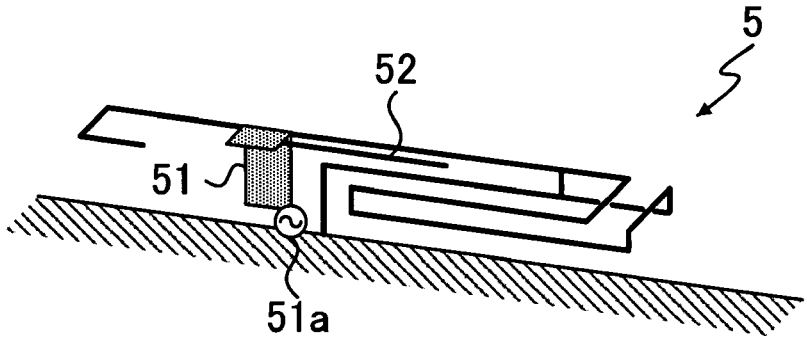
FIG. 36 shows a configuration and an external view of an antenna device of the fourth embodiment.

FIG. 36 shows a configuration and an external view of an antenna device 5 based on modifications of the antenna device 1 as described above. In the antenna device 5, the fed partial element 11 of the antenna device 1 has been replaced by a fed partial element 51, and an open-ended partial element 52 has been further included. As each of other sections of the antenna device 5 is a same as that of the antenna device 1, its explanation and its indication of a reference numeral in FIG. 36 are omitted.

The fed partial element 51 is based on a modification of the fed partial element 11 of the antenna device 1, i.e., being extended as shown in FIG. 31. The open-ended partial element 52 branches off from an extended portion of the fed partial element 51.

Figure 37:
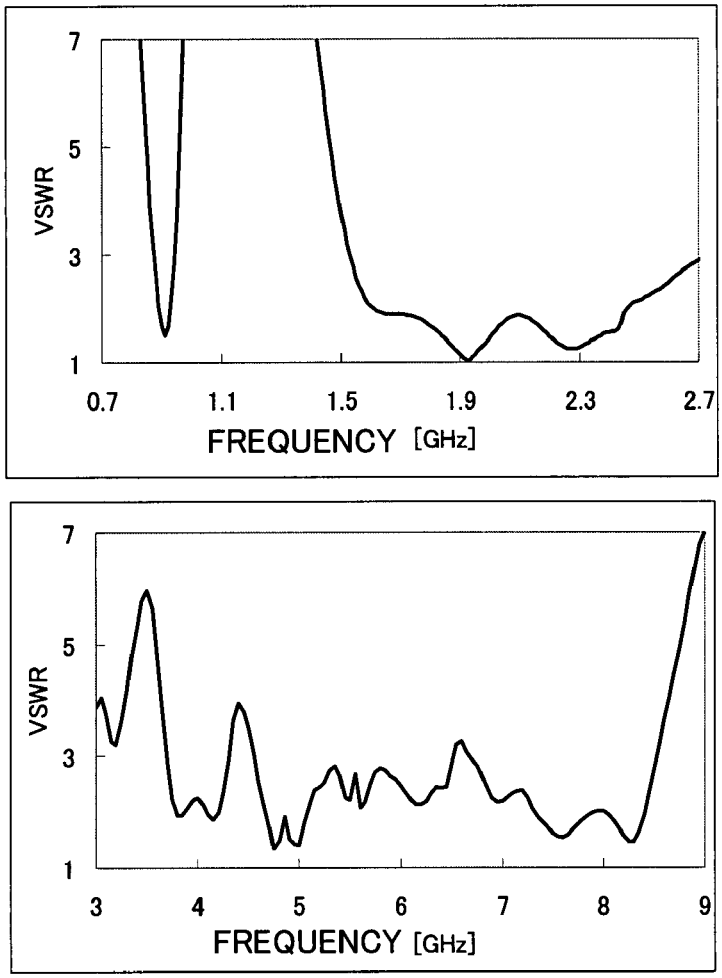
FIG. 37 shows a VSWR-frequency characteristic of a model of the antenna device of the fourth embodiment.

The antenna device 5, configured as shown in FIG. 5 and given a condition of a size of each section, has been evaluated by a simulation in terms of a VSWR at the fed portion 51*a* in a frequency range 0.7-9 GHz. FIG. 37 shows on an upper half thereof a frequency characteristic of the VSWR in a lower portion of the frequency range. FIG. 37 shows on a lower half thereof a frequency characteristic of the VSWR in an upper portion of the frequency range.

As shown in FIG. 37, the antenna device 5 shows a good VSWR characteristic in a broad frequency range which accommodates mobile phones and wireless local area network (WLAN)s.

According to the fourth embodiment of the present invention described above, the antenna device may have additional resonant frequencies or may improve its impedance characteristic by various modifications of the present invention.

The particular hardware or software implementation of the present invention may be varied while still remaining within the scope of the present invention. It is therefore to be understood that within the scope of the appended claims and their equivalents, the invention may be practiced otherwise than as specifically described herein.

What is claimed is:

1. An antenna device of a radio apparatus usable at a first frequency and at a second frequency, comprising:

a fed partial element including a fed portion, a first branch portion and a second branch portion, the fed partial element configured to be fed at the fed portion, the fed partial element being formed in such a manner to be extended from the fed portion to the first branch portion with a width;

a folded partial element branching off from the fed partial element at the first branch portion, the folded partial element including a forward path from the first branch portion to a fold portion and a backward path from the fold portion to a grounded end, the folded partial element and a path on the fed partial element from the fed portion to the first branch portion having a summed length of about a half wavelength of the first frequency, the grounded end located no greater than a one-fifth wavelength of the first frequency apart from the fed portion, the forward path and the backward path short-circuited at a bridge portion; and an open-ended partial element branching off from the fed partial element at the second branch portion, the open-ended partial element having an open end, the open-ended partial element and a path on the fed partial element from the fed portion to the second branch portion having a summed length of about a one-fourth wavelength of the second frequency.

2. The antenna device of claim 1, wherein the bridge portion is located in such a manner that a path length from the fed portion, via the first branch portion and the fold portion, to the grounded end is about a half wavelength of the second frequency.

3. The antenna device of claim 1, wherein the radio apparatus is further usable at a third frequency, and the fed partial element includes a path of an antenna current mainly distributed thereon if activated from the fed portion to the second branch portion avoiding the first branch portion, the path having a length of about a one-fourth wavelength of the third frequency.

4. The antenna device of claim 1, wherein the radio apparatus is further usable at a third frequency, the fed partial element includes a path of an antenna current mainly distributed thereon if activated from the fed portion to the second branch portion avoiding the first branch portion, the path having a length of about a one-fourth wavelength of the third frequency, and the fed partial element is located no greater than a one-twentieth wavelength of the third frequency apart from a ground circuit of the radio apparatus.

5. The antenna device of claim 1, wherein the radio apparatus is further usable at a fourth frequency, and the width of the fed partial element is about a one-fourth wavelength of the fourth frequency.

6. The antenna device of claim 1, wherein the radio apparatus is further usable at a fifth frequency, and the bridge portion is located so that a path length from the fed portion, via the first branch portion and the fold portion, to the grounded end is an integer times of about a half wavelength of the fifth frequency.

7. The antenna device of claim 1, further comprising a parasitic element configured to be inductively coupled to one of the fed portion and the fed partial element.

8. An antenna device of a radio apparatus usable at a first frequency and at a second frequency, comprising:

a fed partial element including a fed portion, a first branch portion and a second branch portion, the fed partial element configured to be fed at the fed portion, the fed partial element configured as a fringe portion of a piece formed in such a manner to be extended from the fed portion to the first branch portion with a width;

a folded partial element branching off from the fed partial element at the first branch portion, the folded partial element including a forward path from the first branch portion to a fold portion and a backward path from the fold portion to a grounded end, the folded partial element and a path on the fed partial element from the fed portion to the first branch portion having a summed length of about a half wavelength of the first frequency, the grounded end located no greater than a one-fifth wavelength of the first frequency apart from the fed portion, the forward path and the backward path short-circuited at a bridge portion; and an open-ended partial element branching off from the fed partial element at the second branch portion, the open-ended partial element having an open end, the open-ended partial element and a path on the fed partial element from the fed portion to the second branch portion having a summed length of about a one-fourth wavelength of the second frequency.

9. The antenna device of claim 8, wherein the bridge portion is located in such a manner that a path length from the fed portion, via the first branch portion and the fold portion, to the grounded end is about a half wavelength of the second frequency.

10. The antenna device of claim 8, wherein the radio apparatus is further usable at a third frequency, and the fed partial element includes a path of an antenna current mainly distributed thereon if activated from the fed portion to the second branch portion avoiding the first branch portion, the path having a length of about a one-fourth wavelength of the third frequency.

11. The antenna device of claim 8, wherein the radio apparatus is further usable at a third frequency, the fed partial element includes a path of an antenna current mainly distributed thereon if activated from the fed portion to the second branch portion avoiding the first branch portion, the path having a length of about a one-fourth wavelength of the third frequency, and the fed partial element is located no greater than a one-twentieth wavelength of the third frequency apart from a ground circuit of the radio apparatus.

12. The antenna device of claim 8, wherein the radio apparatus is further usable at a fourth frequency, and the width of the fed partial element is about a one-fourth wavelength of the fourth frequency.

13. The antenna device of claim 8, wherein the radio apparatus is further usable at a fifth frequency, and the bridge portion is located so that a path length from the fed portion, via the first branch portion and the fold portion, to the grounded end is an integer times of about a half wavelength of the fifth frequency.

14. The antenna device of claim 8, further comprising a parasitic element configured to be inductively coupled to one of the fed portion and the fed partial element.

* * * * *